US005561016A

United States Patent [19]

Suzuki et al.

[11] Patent Number: 5,561,016

[45] Date of Patent: Oct. 1, 1996

[54] ELECTROPHOTOGRAPHIC PHOTOCONDUCTOR

[75] Inventors: Yasuo Suzuki, Fuji; Satoshi Igari, Numazu, both of Japan

[73] Assignee: Ricoh Company, Ltd., Tokyo, Japan

[21] Appl. No.: 143,069

[22] Filed: Oct. 29, 1993

[30] Foreign Application Priority Data

Oct. 29, 1992 [JP] Japan ..... 4-291271

[51] Int. Cl.[6] ..... G03G 5/04

[52] U.S. Cl. ..... 430/59; 430/58; 430/96

[58] Field of Search ..... 430/58, 59, 96

[56] References Cited

U.S. PATENT DOCUMENTS 5,011,757 4/1991 Akasaki ..... 430/58

5,229,237 7/1993 Kawamorita ..... 430/73

5,336,578 8/1994 Nukada ..... 430/78

5,399,452 3/1995 Takegawa ..... 430/58

*Primary Examiner*—Kathleen Duda

*Attorney, Agent, or Firm*—Oblon, Spivak, McClelland, Maier & Neustadt, P.C.

[57] ABSTRACT

An electrophotographic photoconductor composed of an electroconductive support and a photoconductive layer formed thereon, which contains a charge generating material, a binder resin including a butyral resin containing a polyvinyl butyral resin component at a molar ratio of 68 mol % or more, a charge transporting material, and biphenyl or a biphenyl derivative.

9 Claims, 1 Drawing Sheet

ELECTROPHOTOGRAPHIC PHOTOCONDUCTOR

BACKGROUND OF THE INVENTION

1. Field of the Invention

The present invention relates to an electrophotographic photoconductor comprising an electroconductive support and a photoconductive layer formed on the support, which is used in an analog or digital copying machine, laser printer and laser facsimile apparatus.

2. Discussion of Background

Inorganic materials such as selenium, cadmium sulfide and zinc oxide are used as photoconductive materials in conventional electrophotographic photoconductors. While the above-mentioned inorganic materials have shortcomings in toxicity, heat-resistance and manufacturing cost, the electrophotographic photoconductors employing a variety of organic photoconductive materials can be manufactured at low cost by mass production without environmental pollution. Therefore, studies of the organic electrophotographic photoconductor have been made with the aforementioned merits taken into account. Further, a function-separating photoconductor comprising a charge generation layer and a charge transport layer is proposed to obtain high photosensitivity and high durability, and some of the function-separating photoconductors have been put to practical use.

The organic photoconductor is generally fabricated in such a manner that a charge generating material, a charge transporting material and a binder resin are dissolved or dispersed in an organic solvent to prepare a coating liquid for the photoconductive layer, and the thus prepared coating liquid is coated on an electroconductive support and dried under application of heat thereto. Thus, a photoconductive layer is formed on the electroconductive support. However, the residual stress is generated in the photoconductive layer at the drying step in the formation of the photoconductive layer, which causes the curling and peeling problems of the photoconductive layer.

To decrease the residual stress generated in the photoconductive layer, it is proposed to add to a coating liquid for the photoconductive layer a variety of commercially available plasticizers such as alkyl phthalate (as disclosed in Japanese Laid-Open Patent Application 1-134364); o-terphenyl and m-terphenyl (as disclosed in Japanese Laid-Open Patent Application 3-134670); and a biphenyl derivative (as disclosed in Japanese Laid-Open Patent Application 3-75754).

However, the addition of the plasticizer to the photoconductive layer causes some problems in the photoconductive characteristics of the photoconductive layer, for instance, a decrease in photosensitivity and a change in photosensitivity during the repeated operation, especially under the circumstances of high temperature and humidity.

There is no electrophotographic photoconductor capable of meeting the requirements for both the plasticity and the photoconductive characteristics of the photoconductive layer.

SUMMARY OF THE INVENTION

Accordingly, an object of the present invention is to provide an electrophotographic photoconductor which is excellent in mechanical durability and environmental stability, free from the problem of a photoconductive layer curling or peeling from a support, with a low residual potential being maintained.

The above-mentioned object of the present invention can be achieved by an electrophotographic photoconductor comprising an electroconductive support and a photoconductive layer formed thereon, which comprises a charge generating material, a binder resin comprising a butyral resin containing a polyvinyl butyral resin component at a molar ratio of 68 mol % or more, a charge transporting material, and biphenyl or a biphenyl derivative.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
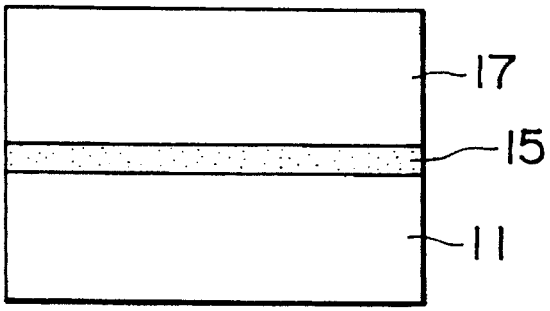
FIGS. 1 to 3 are schematic cross-sectional views of embodiments of an electrophotographic photoconductor according to the present invention.

A photoconductive layer of an electrophotographic photoconductor according to the present invention comprises a binder resin which comprises a butyral resin containing a polyvinyl butyral resin component at a molar ratio of 68 mol % or more, and biphenyl or a derivative thereof serving as a plasticizer. In the present invention, the photoconductive layer may comprise a charge generation layer and a charge transport layer to form a function-separating electrophotographic photoconductor. In this case, the charge generation layer comprises a charge generating material and a binder resin comprising the butyral resin containing a polyvinyl butyral resin component at a molar ratio of 68 mol % or more, and the charge transport layer comprises a charge transporting material, a binder resin and the biphenyl or derivative thereof.

Biphenyl derivatives for use in the photoconductive layer of a single-layered photoconductor, or in the charge transport layer of a function-separating photoconductor may have a substituent such as an alkyl group, an aryl group, benzyl group, or an alkoxyl group.

Specific examples of biphenyl and derivatives thereof are as follows: biphenyl, 2-methylbiphenyl, 3-methylbiphenyl, 4-methylbiphenyl, 2-ethylbiphenyl, 3-ethylbiphenyl, 2,3-dimethylbiphenyl, 2,4-dimethylbiphenyl, 2,5-dimethylbiphenyl, 2,6-dimethylbiphenyl, 2,2'-dimethylbiphenyl, 2,3'-dimethylbiphenyl, 3,5-dimethylbiphenyl, 3,3'-dimethylbiphenyl, 3,4'-dimethylbiphenyl, 2-propylbiphenyl, 4-propylbiphenyl, 2-isopropylbiphenyl, 3-isopropylbiphenyl, 4-isopropylbiphenyl, 2-ethyl-5-methylbiphenyl, 2,4,6-trimethylbiphenyl, 2,4,3'-trimethylbiphenyl, 2,5,3'-trimethylbiphenyl, 2,5,4'-trimethylbiphenyl, 2,6,2'-trimethylbiphenyl, 3,5,4'-trimethylbiphenyl, 2-butylbiphenyl, 4-butylbiphenyl, 2-sec-butylbiphenyl, 4-sec-butylbiphenyl, 2-isobutylbiphenyl, 2-tert-butylbiphenyl, 3-tert-butylbiphenyl, 4-tert-butylbiphenyl, 2,2'-diethylbiphenyl, 3,3'-diethylbiphenyl, 4,4'-diethylbiphenyl, 2,3,2',3'-tetramethylbiphenyl, 2,6,2',6'-tetramethylbiphenyl, 3,4,3',4'-tetramethylbiphenyl, 3,5,3',5'-tetramethylbiphenyl, 4-hexylbiphenyl, 4,4'-dipropylbiphenyl, 2,2'-diisopropylbiphenyl, 4,4'-diisopropylbiphenyl, 2,4,6,2',4',6'-hexamethylbiphenyl, 4,4'-dibutylbiphenyl, 2,5-di-tert-butylbiphenyl, 2,2'-di-tert-butylbiphenyl, 4,4'-di-tert-butylbiphenyl, 2,3,5,6,2',3',5',6'-octamethylbiphenyl, 4,4'-di-tert-pentylbiphenyl, hydrogenated terphenyl, o-terphenyl, m-terphenyl, p-benzylbiphenyl, 5'-methyl-m-terphenyl, 4-phenylbiphenzyl, 4',5'-dimethyl-m-terphenyl, 4',6'-dimethyl-m-terphenyl, 1-ethyl-4-benzylbiphenyl, 4-propyl-m-terphenyl, 3',4',6'-trimethyl-o-terphenyl, 2',4',5'-trimethyl-m-terphenyl, 2',4',6'-trimethyl-m-terphenyl, 4-ethyl-4'-phenethylbiphenyl, 3-pentyl-m-terphenyl, 2-methoxybiphenyl, 2-ethoxybiphenyl, 2-propoxybiphenyl, 2-phenoxybiphenyl, 2-benzyloxybiphenyl, 3-methoxybiphenyl, 4-methoxybiphenyl, 4-ethoxybiphenyl, 4-propoxybiphenyl, 4-isopropoxybiphenyl, 4-butoxybiphenyl, 4-pentyloxybiphenyl, 4-phenoxybiphenyl, 4-m-tolyloxybiphenyl, 4-p-tolyloxybiphenyl, 4-benzyloxybiphenyl, 4'-methoxy-3-methylbiphenyl, 4-methoxy-4'-methylbiphenyl, 4-cyclohexyloxymethylbiphenyl, 2-ethyl-5-methoxybiphenyl, 4'-methoxyl-3,4-dimethylbiphenyl, 3'-methoxy-o-terphenyl, 4'-methoxy-o-terphenyl, 5-benzyl-2-methoxy-biphenyl, 4-benzyl-4'-methoxybiphenyl, and 4-(α-methoxybenzyl)biphenyl.

It is preferable that the amount of biphenyl or the above-mentioned biphenyl derivative be 5 to 50 parts by weight to 100 parts by weight of a binder resin in the photoconductive layer of the single-layered photoconductor or in the charge transport layer of the function-separating photoconductor. When the amount of biphenyl or the derivative thereof contained in the photoconductive layer or the charge transport layer is within the above-mentioned range, biphenyl or derivative thereof can exhibit a sufficient plasticizing effect to reduce the residual stress in the photoconductive layer or the charge transport layer, so that the curling and peeling of the photoconductive layer can be prevented. Further, the photoconductive characteristics of the obtained photoconductor are not impaired by the addition of biphenyl or the derivative thereof in the above-mentioned amount. More specifically, the photosensitivity of the photoconductor is not decreased, and the residual potential is not increased.

The previously mentioned biphenyl and derivatives thereof are excellent in compatibility in the photoconductive layer or the charge transport layer, and they are stable to light, heat and ozone ($O_3$), so that they have no adverse effect on other components contained in the photoconductor.

According to the present invention, the photoconductive layer of the single-layered photoconductor or the charge generation layer of the function-separating photoconductor comprises a binder resin comprising a butyral resin of formula (I), which is synthesized by allowing polyvinyl alcohol to react with butyl aldehyde. The butyral resin for use in the present invention is composed of three kinds of repeat units as shown in formula (I) in view of circumstances in the synthesizing process of polyvinyl alcohol and the synthesizing process of butyral resin.

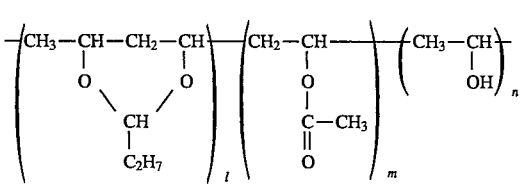

(I)

(wherein l, m and n respectively indicate the polymerization degree of a vinyl butyral resin component, that of a vinyl acetate resin component and that of a vinyl alcohol resin component.)

The physical and chemical properties of the obtained butyral resin vary depending on the composition thereof, and the thermal and mechanical properties and the solution viscosity of the obtained butyral resin vary depending on the polymerization degree of each repeat unit.

The butyral resin for use in the present invention comprises a polyvinyl butyral resin component at a molar ratio of 68 mol % or more. It is preferable that the polyvinyl alcohol resin component be contained in the butyral resin for use in the present invention at a molar ratio of less than 30 mol %.

The reasons for the advantages resulting from the use of the aforementioned butyral resin have not been clarified, but it is considered that carriers generated in the charge generation layer can be transported to the charge transport layer very smoothly when the above-mentioned butyral resin is, for example, used as the binder resin in the charge generation layer of the function-separating photoconductor. In addition to the above, the physical properties of the butyral resin for use in the present invention are stable to the environmental conditions.

The present invention will now be explained in detail by referring to the accompanying drawings.

FIG. 1 is a cross-sectional view of a first embodiment of an electrophotographic photoconductor according to the present invention. As shown in FIG. 1, a charge generation layer 15 and a charge transport layer 17 are successively formed on an electroconductive support 11 in this order.

Figure 2:
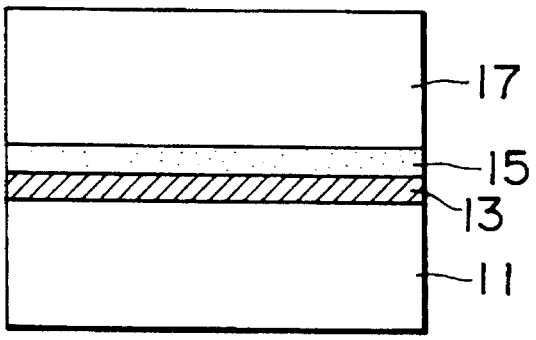

FIG. 2 is a cross-sectional view of a second embodiment of an electrophotographic photoconductor according to the present invention. The photoconductor shown in FIG. 2 comprises an undercoat layer 13, a charge generation layer 15 and a charge transport layer 17 which are successively overlaid on an electroconductive support 11 in this order.

Figure 3:
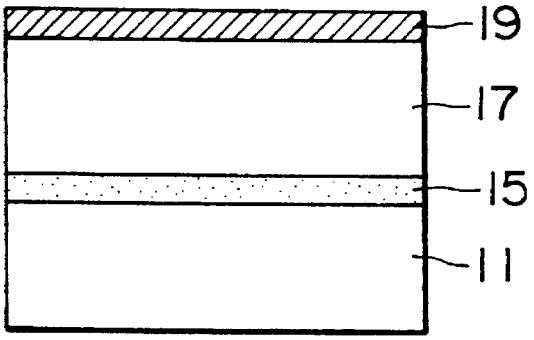

FIG. 3 is a cross-sectional view of a third embodiment of an electrophotographic photoconductor according to the present invention. The photoconductor shown in FIG. 3 comprises a charge generation layer 15, a charge transport layer 17 and a protective layer 19 which are successively overlaid on an electroconductive support 11 in this order.

In the electrophotographic photoconductors as shown in FIGS. 1 to 3, the charge transport layer 17, comprises biphenyl or the previously mentioned biphenyl derivative, and the charge generation layer 15 comprises the butyral resin for use in the present invention.

To prepare the electroconductive support 11, an electroconductive material with a volume resistivity of $10^{10}$ Ω.cm or less, for example, a metal such as aluminum, nickel, chromium, nichrome, copper, silver, gold or platinum; and a metallic oxide such as thin oxide or indium oxide is coated by vacuum deposition or sputtering on a plastic film or a sheet of paper, which may be fabricated in a cylindrical form. Alternatively, a plate of aluminum, aluminum alloy, nickel or stainless steel can be used as the electroconductive support 11; and the above-mentioned metal plate may be made into a tube by extrusion or pultrusion and subjected to surface treatment such as cutting, superfinishing and grinding to employ as the electroconductive support 11.

In addition to the above, electroconductive finely-divided particles dispersed in an appropriate binder resin may be coated on the above-mentioned materials used for the electroconductive support 11, so that an electroconductive layer is formed on the support 11.

Specific examples of the electroconductive finely-divided particles for use in the electroconductive layer include carbon black; acetylene black; powder of metals such as aluminum, nickel, iron, nichrome, copper, zinc and silver; and powder of metallic oxides such as electroconductive titanium oxide, electroconductive tin oxide and indium tin oxide (ITO).

Specific examples of the binder resin used with the above-mentioned electroconductive finely-divided particles are thermoplastic, thermosetting or photosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin. A mixture of the aforementioned electroconductive finely-divided particles and binder resin may be dispersed in an appropriate solvent such as tetrahydrofuran, dichloromethane, methyl ethyl ketone or toluene, and the thus prepared coating liquid may be coating on the material for the electroconductive support 11 to form the electroconductive layer.

After the formation of a photoconductive layer, the coating liquid for the electroconductive layer may be applied to both sides of the electroconductive support 11 in such a fashion that the electroconductive layer partially overlaps with the photoconductive layer when the photoconductor is fabricated in the form of a drum.

Furthermore, a heat-shrinkable tubing in which the above-mentioned electroconductive finely-divided particles are dispersed in a material such as polyvinyl chloride, polypropylene, polyester, polystyrene, polyvinylidene chloride, polyethylene, chlorinated rubber or Teflon may be provided on the periphery of a cylindrical electroconductive support 11.

In the case of the function-separating electrophotographic photoconductor, the charge generation layer 15 comprises a charge generating material and the previously mentioned butyral resin in the present invention.

Examples of the charge generating material for use in the photoconductive layer or the charge generation layer are organic pigments such as C.I. Pigment Blue 25 (C.I. 21180), C.I. Pigment Red 41 (C.I. 21200), C.I. Acid Red 52 (C.I. 45100) and C.I. Basic Red 3 (C.I. 45210); an azo pigment having a carbazole skeleton (Japanese Laid-Open Patent Application 53-95033), an azo pigment having a stilbene skeleton (Japanese Laid-Open Patent Application 53-138229), an azo pigment having a distyryl benzene skeleton (Japanese Laid-Open Patent Application 53-133455), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-17734), a trisazo pigment having a carbazole skeleton (Japanese Laid-Open Patent Applications 57-195767 and 57-195758), and an azo pigment having an oxazole skeleton; a phthalocyanine pigment such as C.I. Pigment Blue 16 (C.I. 74100); indigo pigments such as C.I. Vat Brown 5 (C.I. 73410) and C.I. Vat Dye (C.I. 73030); perylene pigments such as Algol Scarlet B and Indanthrene Scarlet R (made by Bayer Co., Ltd.); a squaric pigment; and a polycyclic quinone pigment such as 4,10-dibromo anthoanthrone. These charge generating materials can be used alone or in combination. It is preferable that the amount of the butyral resin be in the range from 5 to 500 parts by weight, more preferably in the range from 10 to 200 parts by weight, to 100 parts by weight of the charge generating material.

The charge generation layer 15 can be formed on the electroconductive support 11 by dispersing the above-mentioned charge generating material, with addition of the butyral resin for use in the present invention, in a solvent such as tetrahydrofuran, cyclohexanone, dioxane, dichloroethane, methyl ethyl ketone or ethyl cellosolve in a ball mill, an attritor or a sand mill to prepare a dispersion, diluting the dispersion properly, and then coating the thus prepared diluent on the electroconductive support 11 by dip coating, spray coating or bead coating.

The thickness of the charge generation layer is preferably in the range from about 0.01 to 5 μm, more preferably in the range from 0.1 to 2 μm.

In the case of the function-separating electrophotographic photoconductor, the charge transport layer 17 comprises a charge transporting material such as a high-molecular charge transporting material or a low-molecular charge transporting material, a binder resin and biphenyl or the previously mentioned biphenyl derivative.

The charge transporting material for use in the charge transport layer 17 includes a positive hole transporting material and an electron transporting material.

Examples of the electron transporting material are electron acceptor materials such as chloroanil, bromoanil, tetracyanoethylene, tetracyanoquinone-dimethane, 2,4,7-trinitro-9-fluorenone, 2,4,5,7-tetranitro-9-fluorenone, 2,4,5,7-tetranitroxanthone, 2,4,8-trinitrothioxanthone, and 2,6,8-trinitro-4H-indeno{1,2-b}thiophene-4-on, 1,3,7-trinitrodibenzothiophene-5,5-dioxide.

Examples of the positive hole transporting material are poly-N-vinylcarbazole and derivatives thereof, poly-γ-carbazolyl ethyl glutamate and derivatives thereof, pyrene-formaldehyde condensate and derivatives thereof, polyvinyl pyrene, polyvinyl phenanthrene, oxazole derivatives, oxadiazole derivatives, imidazole derivatives, monoarylamine derivatives, diarylamine derivatives, triarylamine derivatives, stilbene derivatives, α-phenyl stilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, and butadiene derivatives.

From the viewpoints of photosensitivity, light resistance, gas resistance and compatibility with the plasticizer in the photoconductive layer of the single-layered photoconductor or in the charge transport layer 17 of the function-separating photoconductor, it is preferable that the charge transporting material comprise a stilbene derivative represented by formula (II):

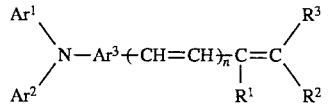

(II)

wherein $Ar^1$ and $Ar^2$ each is an aryl group which may have a substituent or a heterocyclic group which may have a substituent; $R^1$, $R^2$, and $R^3$ each is hydrogen, an alkyl group which may have a substituent, an alkoxyl group which may have a substituent, an aryl group which may have a substituent, or a heterocyclic group which may have a substituent, and $R^2$ and $R^3$ may form a ring in combination; $Ar^3$ is allylene group which may have a substituent; and n is an integer of 0 or 1.

Specific examples of the stilbene derivative of formula (II) are shown in Table 1.

TABLE 1
| Compound No. | $Ar^1$ | $Ar^2$ | $Ar^3$ | $R^1$ | $R^2$ | $R^3$ |
|---|---|---|---|---|---|---|
| (a) n = 0 | | | | | | |
| 1-1 | 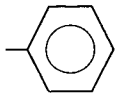 | 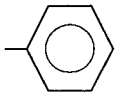 | 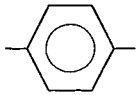 | −H | −H | 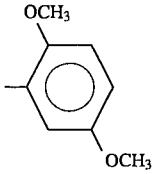  |
| 1-2 | 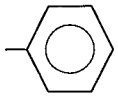 | 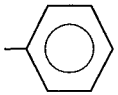 | 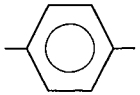 | −H | −H | 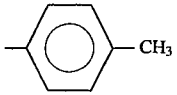  |
| 1-3 | 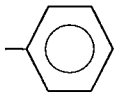 | 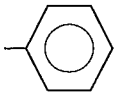 | 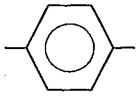 | −H | −H | 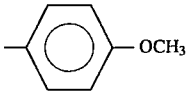  |
| 1-4 | 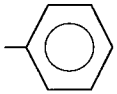 | 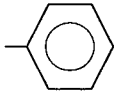 | 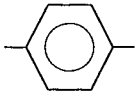 | −H | −H | 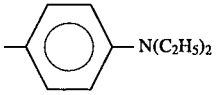  |
| 1-5 | 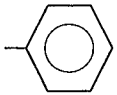 | 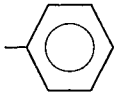 | 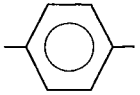 | −H | 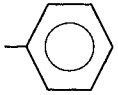 | 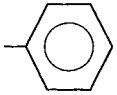 |
| 1-6 | 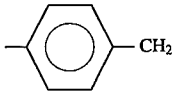  | 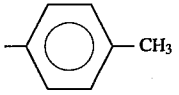  | 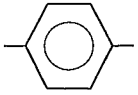 | −H | 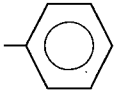 | 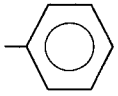 |
| 1-7 | 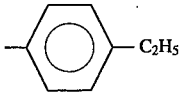  | 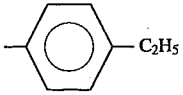  | 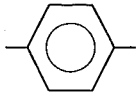 | −H | 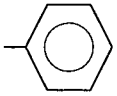 | 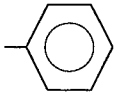 |
| 1-8 | 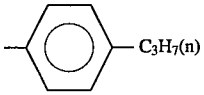  | 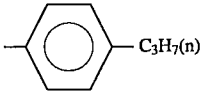  | 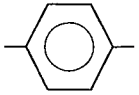 | −H | 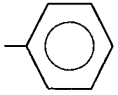 | 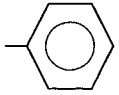 |

TABLE 1-continued
| Compound No. | $Ar^1$ | $Ar^2$ | $Ar^3$ | $R^1$ | $R^2$ | $R^3$ |
|---|---|---|---|---|---|---|
| 1-9 | 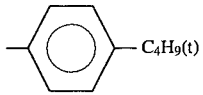 | 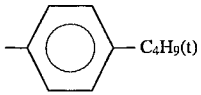 | 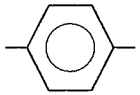 | −H | 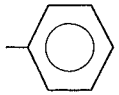 | 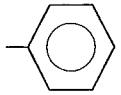 |
| 1-10 | 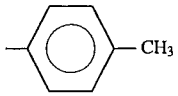 | 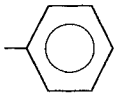 | 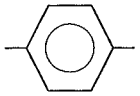 | −H | 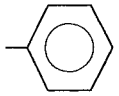 | 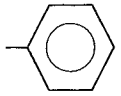 |
| 1-11 | 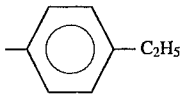 | 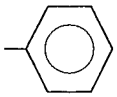 | 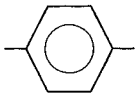 | −H | −H | 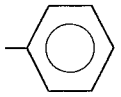 |
| 1-12 | 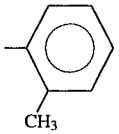 | 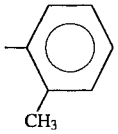 | 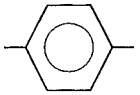 | −H | 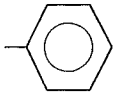 | 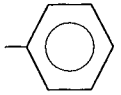 |
| 1-13 | 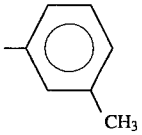 | 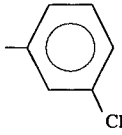 | 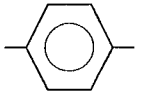 | −H | 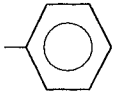 | 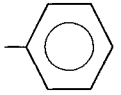 |
| 1-14 | 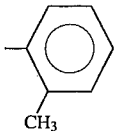 | 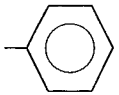 | 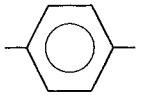 | −H | 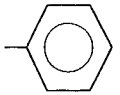 | 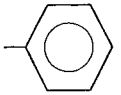 |
| 1-15 | 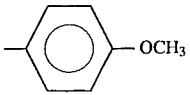 | 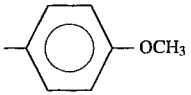 | 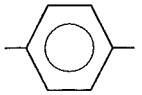 | −H | 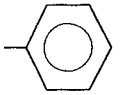 | 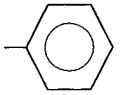 |
| 1-16 | 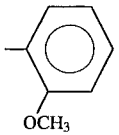 | 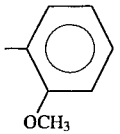 | 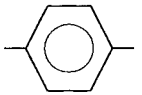 | −H | 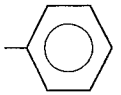 | 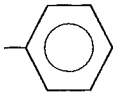 |

TABLE 1-continued
| Compound No. | $Ar^1$ | $Ar^2$ | $Ar^3$ | $R^1$ | $R^2$ | $R^3$ |
|---|---|---|---|---|---|---|
| 1-17 | 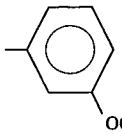 | 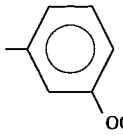 | 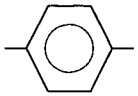 | −H | 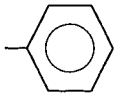 | 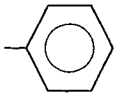 |
| 1-18 | 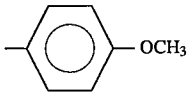 | 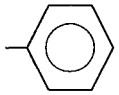 | 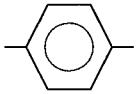 | −H | 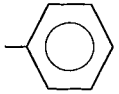 | 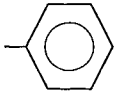 |
| 1-19 | 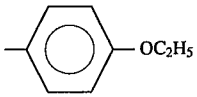 | 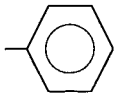 | 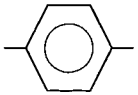 | −H | 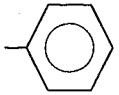 | 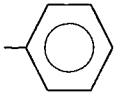 |
| 1-20 | 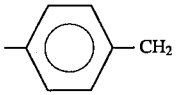 | 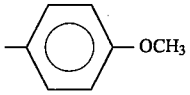 | 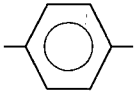 | −H | 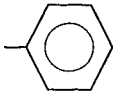 | 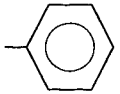 |
| 1-21 | 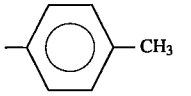 | 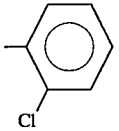 | 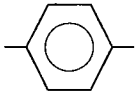 | −H | 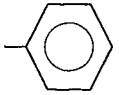 | 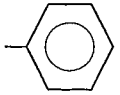 |
| 1-22 | 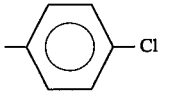 | 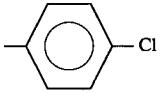 | 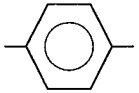 | −H | 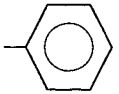 | 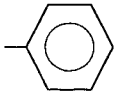 |
| 1-23 | 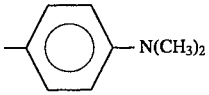 | 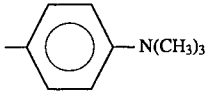 | 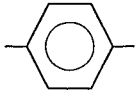 | −H | 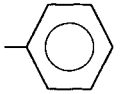 | 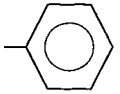 |
| 1-24 | 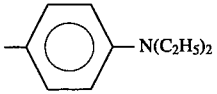 | 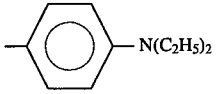 | 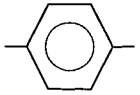 | −H | 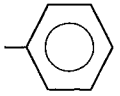 | 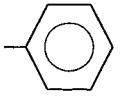 |

TABLE 1-continued
| Compound No. | $Ar^1$ | $Ar^2$ | $Ar^3$ | $R^1$ | $R^2$ | $R^3$ |
|---|---|---|---|---|---|---|
| 1-25 | 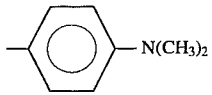 | 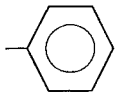 | 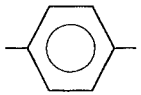 | −H | 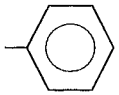 | 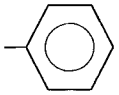 |
| 1-26 | 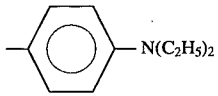 | 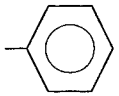 | 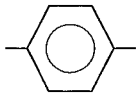 | −H | 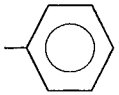 | 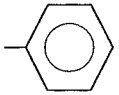 |
| 1-27 | 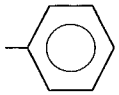 | 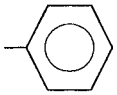 | 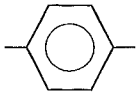 | −H | −H | 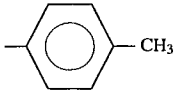 |
| 1-28 | 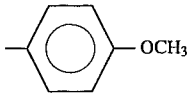 | 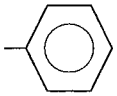 | 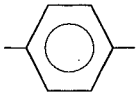 | −H | −H | 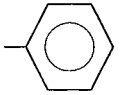 |
| 1-29 | 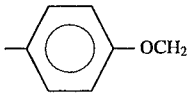 | 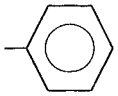 | 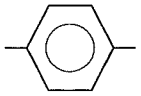 | −H | −H | 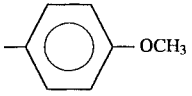 |
| 1-30 | 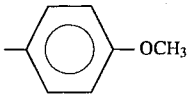 | 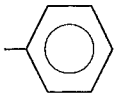 | 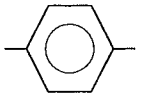 | −H | −H | 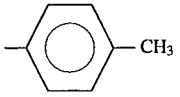 |
| 1-31 | 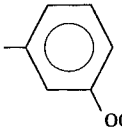 | 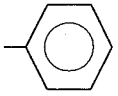 | 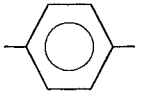 | −H | 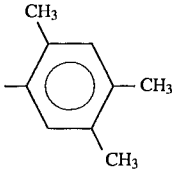 | 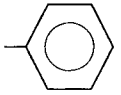 |
| 1-32 | 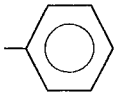 | 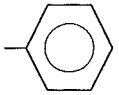 | 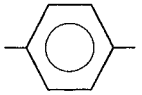 | −H | −H | 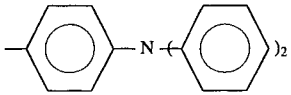 |

TABLE 1-continued
| Compound No. | $Ar^1$ | $Ar^2$ | $Ar^3$ | $R^1$ | $R^2$ | $R^3$ |
|---|---|---|---|---|---|---|
| 1-33 | 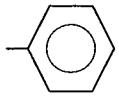 | 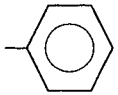 | 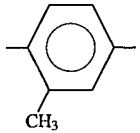 | −H | −H | 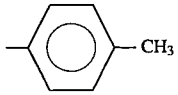 |
| 1-34 | 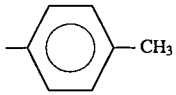 | 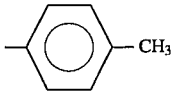 | 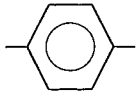 | −H | −H | 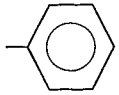 |
| 1-35 | 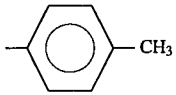 | 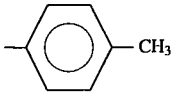 | 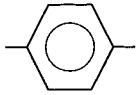 | −H | −H | 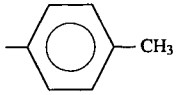 |
| 1-36 | 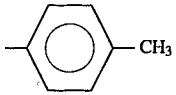 | 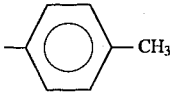 | 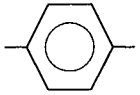 | −H | −H | 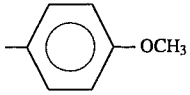 |
| 1-37 | 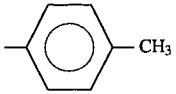 | 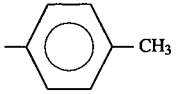 | 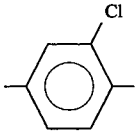 | −H | −H | 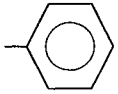 |
| 1-38 | 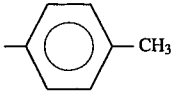 | 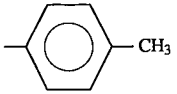 | 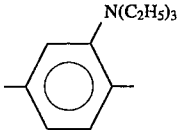 | −H | −H | 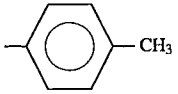 |
| 1-39 | 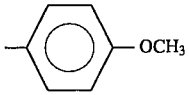 | 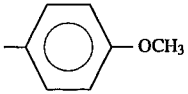 | 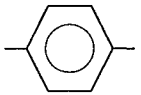 | −H | −H | 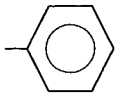 |
| 1-40 | 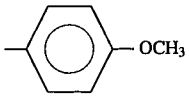 | 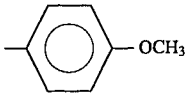 | 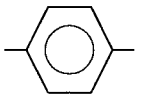 | −H | −H | 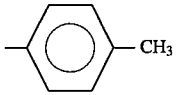 |

TABLE 1-continued
| Compound No. | $Ar^1$ | $Ar^2$ | $Ar^3$ | $R^1$ | $R^2$ | $R^3$ |
|---|---|---|---|---|---|---|
| 1-41 | 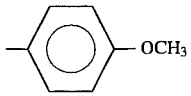 | 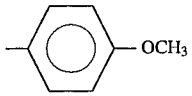 | 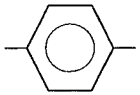 | −H | −H | 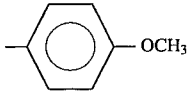 |
| 1-42 | 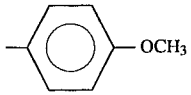 | 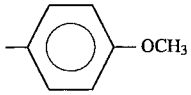 | 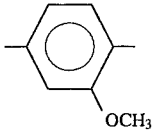 | −H | −H | 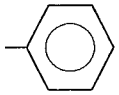 |
| 1-43 | 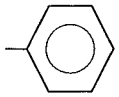 | 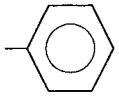 | 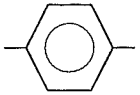 | −H | −H | 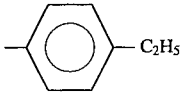 |
| 1-44 | 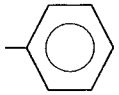 | 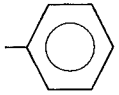 | 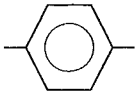 | −H | −H | 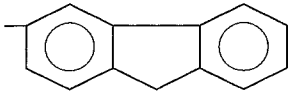 |
| 1-45 | 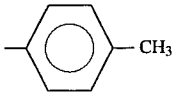 | 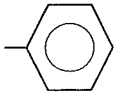 | 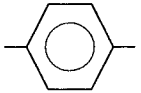 | −H | −H | 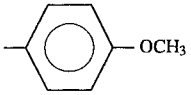 |
| 1-46 | 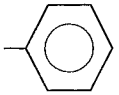 | 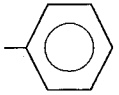 | 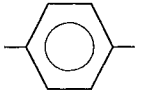 | −H | −H | 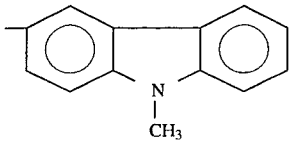 |
| 1-47 | 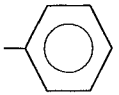 | 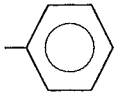 | 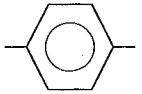 | −H | −H | 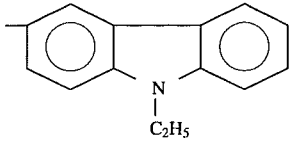 |
| 1-48 | 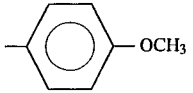 | 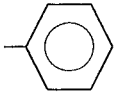 | 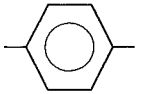 | −H | −H | 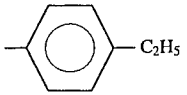 |

TABLE 1-continued
| Compound No. | $Ar^1$ | $Ar^2$ | $Ar^3$ | $R^1$ | $R^2$ | $R^3$ |
|---|---|---|---|---|---|---|
| 1-49 | 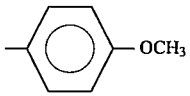 | 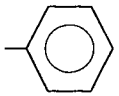 | 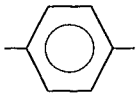 | −H | −H | 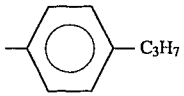 |
| 1-50 | 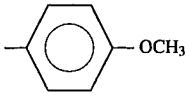 | 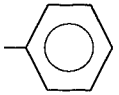 | 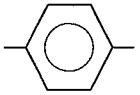 | −H | −H | 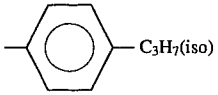 |
| 1-51 | 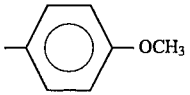 | 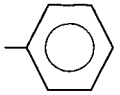 | 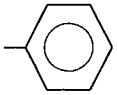 | −H | −H | 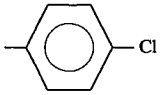 |
| 1-52 | 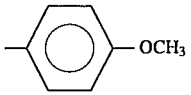 | 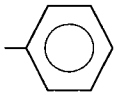 | 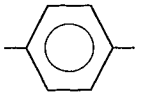 | −H | −H | 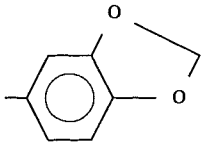 |
| 1-53 | 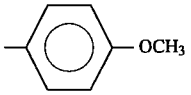 | 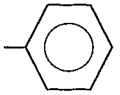 | 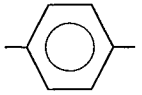 | −H | −H | 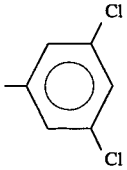 |
| 1-54 | 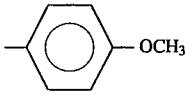 | 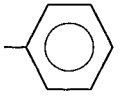 | 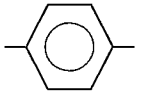 | −H | −H | 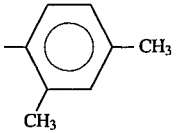 |
| 1-55 | 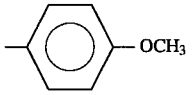 | 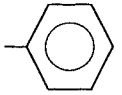 | 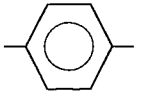 | −H | −H | 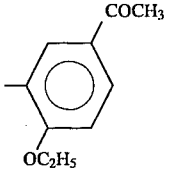 |

TABLE 1-continued
| Compound No. | $Ar^1$ | $Ar^2$ | $Ar^3$ | $R^1$ | $R^2$ | $R^3$ |
|---|---|---|---|---|---|---|
| 1-56 | 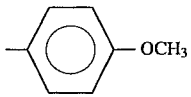 | 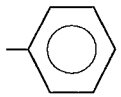 | 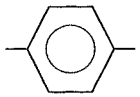 | −H | −H | 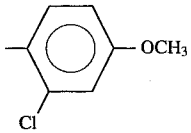 |
| 1-57 | 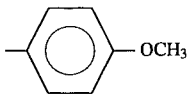 | 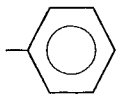 | 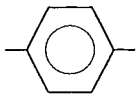 | −H | −H | 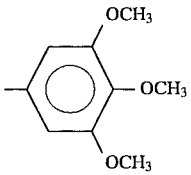 |
| 1-58 | 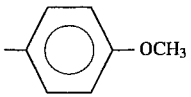 | 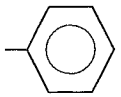 | 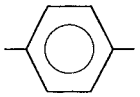 | −H | −H | 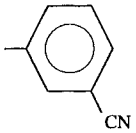 |
| 1-59 | 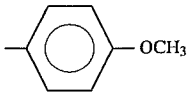 | 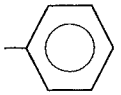 | 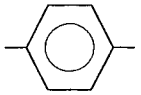 | −H | −H | 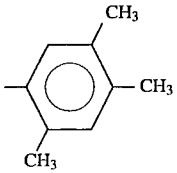 |
| 1-60 | 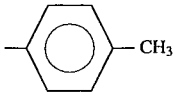 | 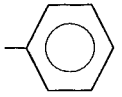 | 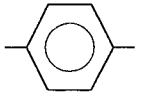 | −H | −H | 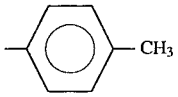 |
| 1-61 | 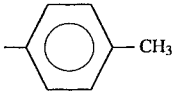 | 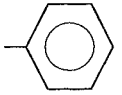 | 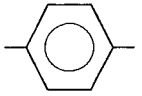 | −H | −H | 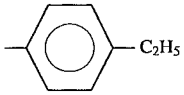 |
| 1-62 | 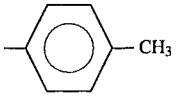 | 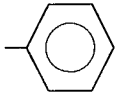 | 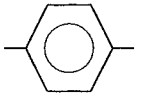 | −H | −H | 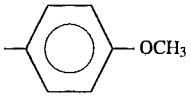 |

TABLE 1-continued
| Compound No. | $Ar^1$ | $Ar^2$ | $Ar^3$ | $R^1$ | $R^2$ | $R^3$ |
|---|---|---|---|---|---|---|
| 1-63 | 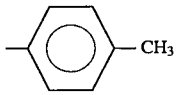 | 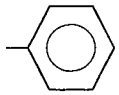 | 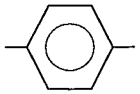 | −H | −H | 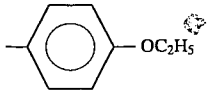 |
| 1-64 | 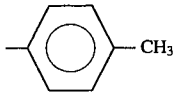 | 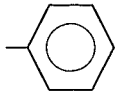 | 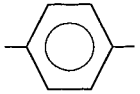 | −H | −H | 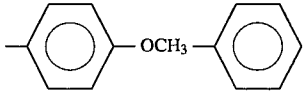 |
| 1-65 | 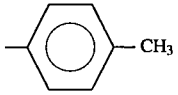 | 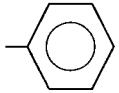 | 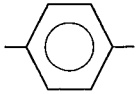 | −H | −H | 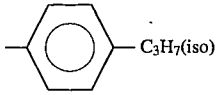 |
| 1-66 | 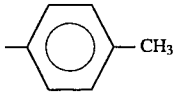 | 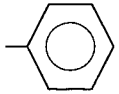 | 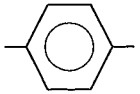 | −H | −H | 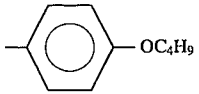 |
| 1-67 | 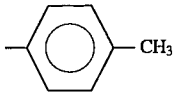 | 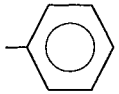 | 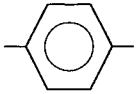 | −H | −H | 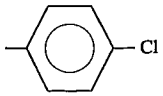 |
| 1-68 | 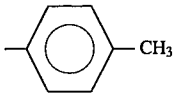 | 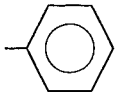 | 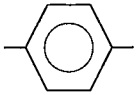 | −H | −H | 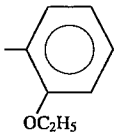 |
| 1-69 | 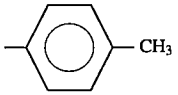 | 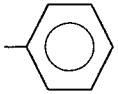 | 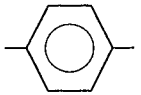 | −H | −H | 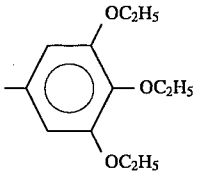 |
| 1-70 | 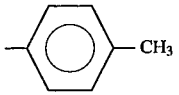 | 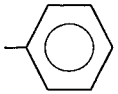 | 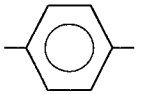 | −H | −H | 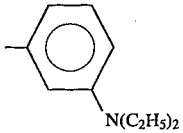 |

TABLE 1-continued
| Compound No. | $Ar^1$ | $Ar^2$ | $Ar^3$ | $R^1$ | $R^2$ | $R^3$ |
|---|---|---|---|---|---|---|
| 1-71 | 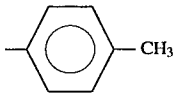 | 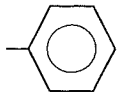 | 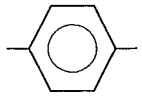 | −H | −H | 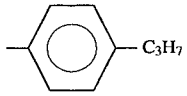 |
| 1-72 | 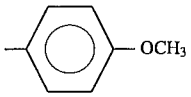 | 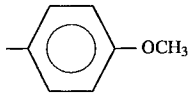 | 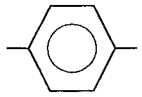 | −H | −H | 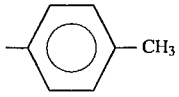 |
| 1-73 | 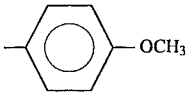 | 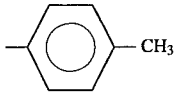 | 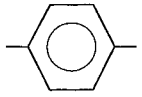 | −H | −H | 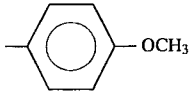 |
| 1-74 | 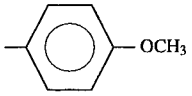 | 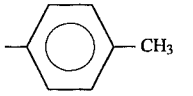 | 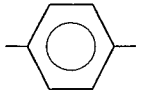 | −H | −H | 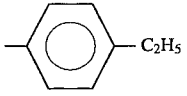 |
| 1-75 | 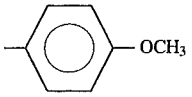 | 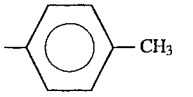 | 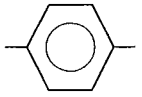 | −H | −H | 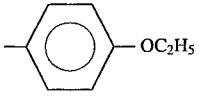 |
| 1-76 | 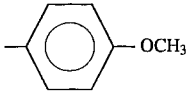 | 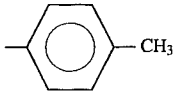 | 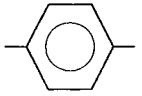 | −H | −H | 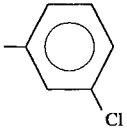 |
| 1-77 | 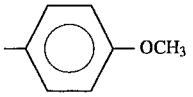 | 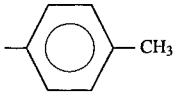 | 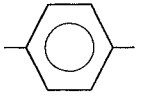 | −H | −H | 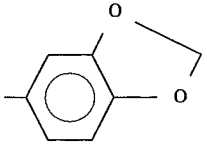 |
| 1-78 | 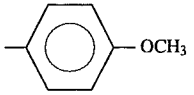 | 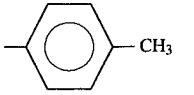 | 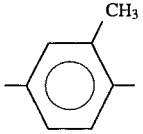 | −H | −H | 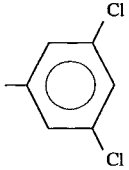 |

TABLE 1-continued
| Compound No. | $Ar^1$ | $Ar^2$ | $Ar^3$ | $R^1$ | $R^2$ | $R^3$ |
|---|---|---|---|---|---|---|
| 1-79 | 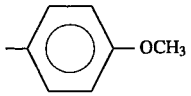 | 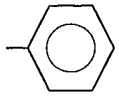 | 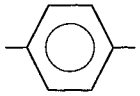 | −H | −H | 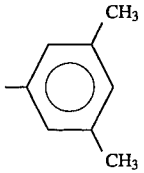 |
| 1-80 | 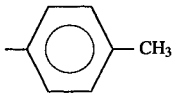 | 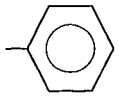 | 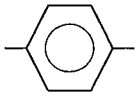 | −H | −H | 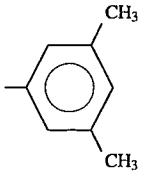 |
| 1-81 | 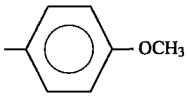 | 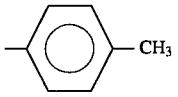 | 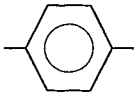 | −H | −H | 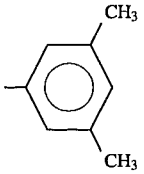 |
| 1-82 | 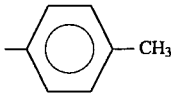 | 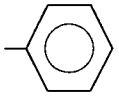 | 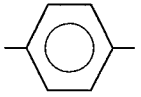 | −H | −H | 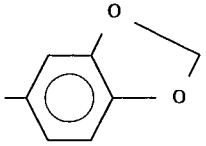 |
| 1-83 | 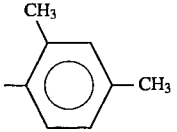 | 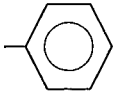 | 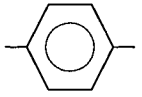 | $-CH_3$ | −H | 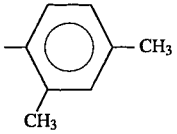 |
| 1-84 | 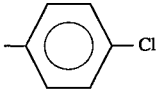 | 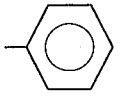 | 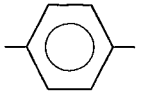 | $-CH_3$ | −H | 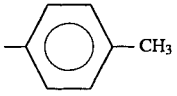 |

TABLE 1-continued
| Compound No. | $Ar^1$ | $Ar^2$ | $Ar^3$ | $R^1$ | $R^2$ | $R^3$ |
|---|---|---|---|---|---|---|
| 1-85 | 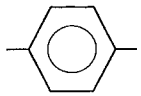 | 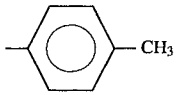 | 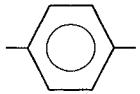 | −H | $-CH_3$ | 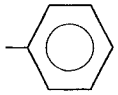 |
| 1-86 | 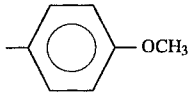 | 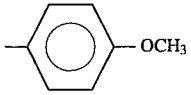 | 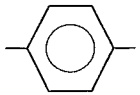 | −H | $-CH_3$ | 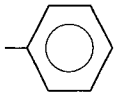 |
| 1-87 | 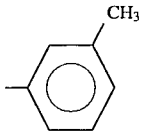 | 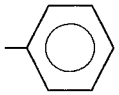 | 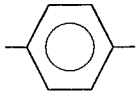 | −H | 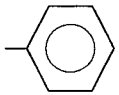 | 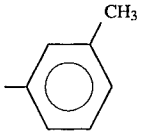 |
| 1-88 | 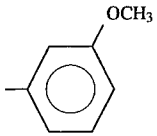 | 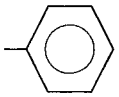 | 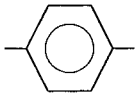 | −H | 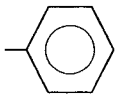 | 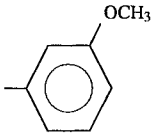 |
| 1-89 | 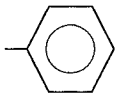 | 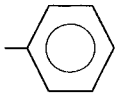 | 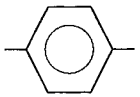 | −H | 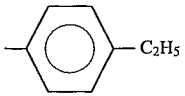 $C_2H_5$ | 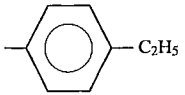 $C_2H_5$ |
| 1-90 | 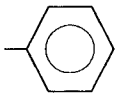 | 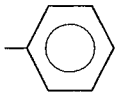 | 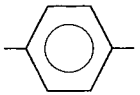 | −H | −H | 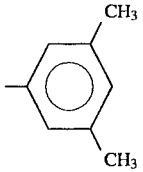 |
| 1-91 | 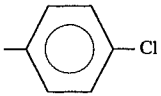 | 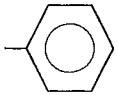 | 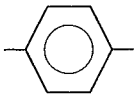 | −H | −H | 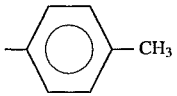 |
| 1-92 | 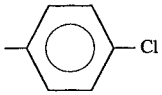 | 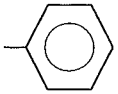 | 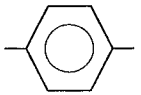 | −H | 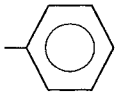 | 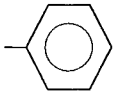 |

TABLE 1-continued
| Compound No. | $Ar^1$ | $Ar^2$ | $Ar^3$ | $R^1$ | $R^2$ | $R^3$ |
|---|---|---|---|---|---|---|
| 1-93 | 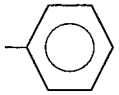 | 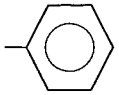 | 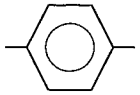 | −H | 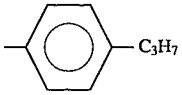 | 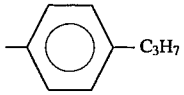 |
| 1-94 | 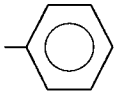 | 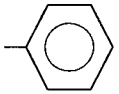 | 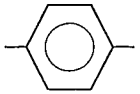 | −H | −H | 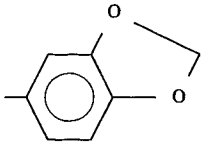 |
| 1-95 | 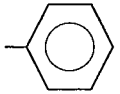 | 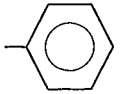 | 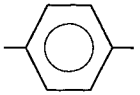 | −H | 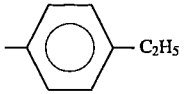 | 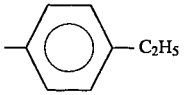 |
| 1-96 | 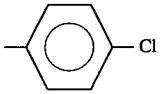 | 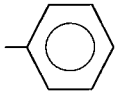 | 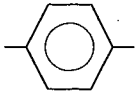 | −H | −H | 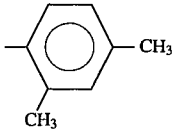 |
| 1-97 | 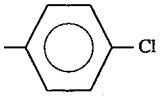 | 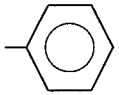 | 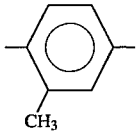 | −H | 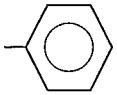 | 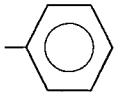 |
| 1-98 | 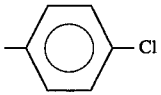 | 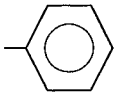 | 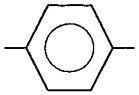 | −H | −H | 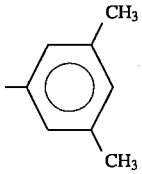 |
| 1-99 | 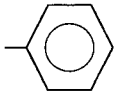 | 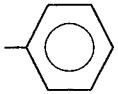 | 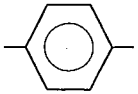 | −H | −H | 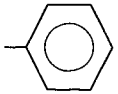 |

TABLE 1-continued
| Compound No. | $Ar^1$ | $Ar^2$ | $Ar^3$ | $R^1$ | $R^2$ | $R^3$ |
|---|---|---|---|---|---|---|
| 1-100 | 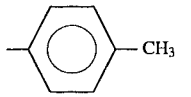 | 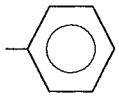 | 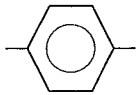 | −H | −H | 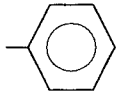 |
| 1-101 | 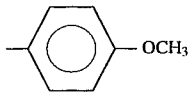 | 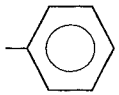 | 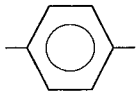 | −H | 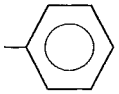 | 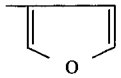 |
| 1-102 | 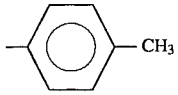 | 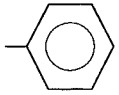 | 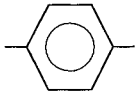 | −H | −H | 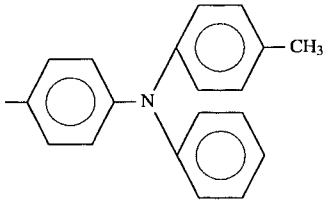 |
| 1-103 | 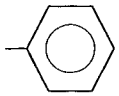 | 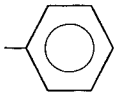 | 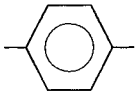 | −H | 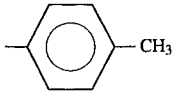 | 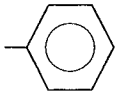 |
| 1-104 | 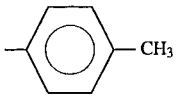 | 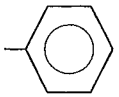 | 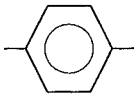 | −H | 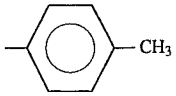 | 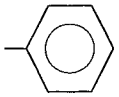 |
| 1-105 | 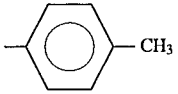 | 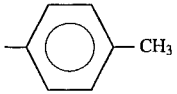 | 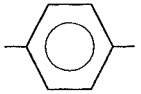 | −H | 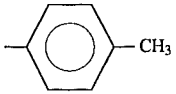 | 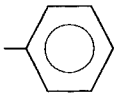 |
| 1-106 | 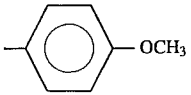 | 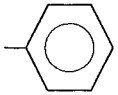 | 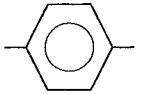 | −H | 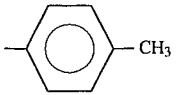 | 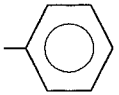 |
| 1-107 | 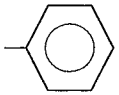 | 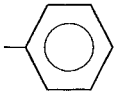 | 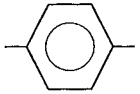 | −H | 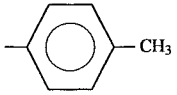 | 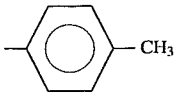 |

TABLE 1-continued
| Compound No. | $Ar^1$ | $Ar^2$ | $Ar^3$ | $R^1$ | $R^2$ | $R^3$ |
|---|---|---|---|---|---|---|
| 1-108 | 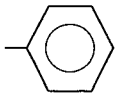 | 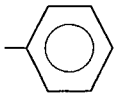 | 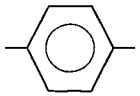 | −H | | 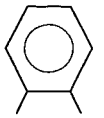 O 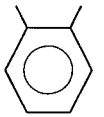 |
| 1-109 | 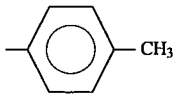 | 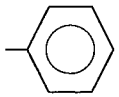 | 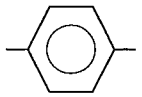 | −H | | 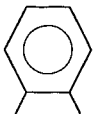 O 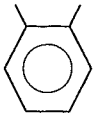 |
| 1-110 | 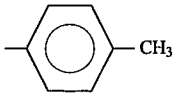 | 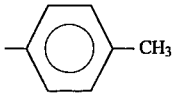 | 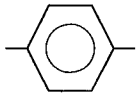 | −H | | 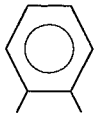 O 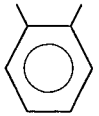 |

TABLE 1-continued
| Compound No. | $Ar^1$ | $Ar^2$ | $Ar^3$ | $R^1$ | $R^2$ | $R^3$ |
|---|---|---|---|---|---|---|
| 1-111 | 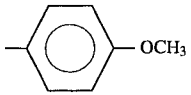 | 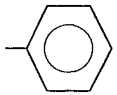 | 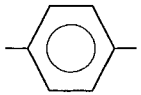 | −H | | 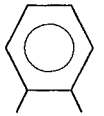 O 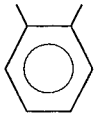 |
| 1-112 | 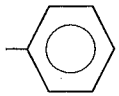 | 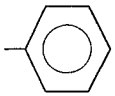 | 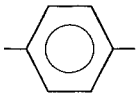 | −H | | 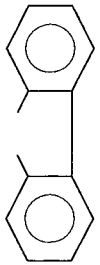 |
| 1-113 | 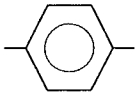 | 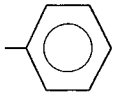 | 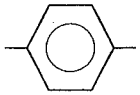 | −H | | 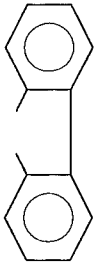 |

TABLE 1-continued
| Compound No. | $Ar^1$ | $Ar^2$ | $Ar^3$ | $R^1$ | $R^2$ | $R^3$ |
|---|---|---|---|---|---|---|
| 1-114 | 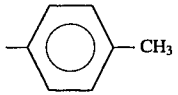 | 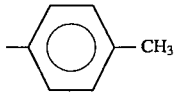 | 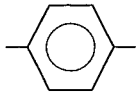 | −H | | 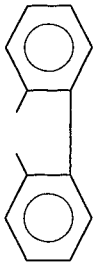 |
| 1-115 | 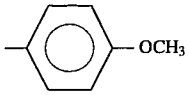 | 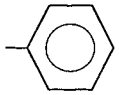 | 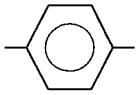 | −H | | 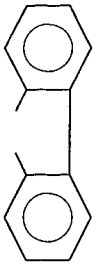 |
| 1-116 | 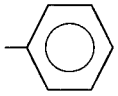 | 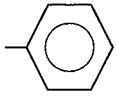 | 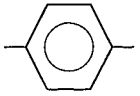 | −H | | 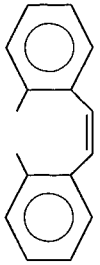 |

TABLE 1-continued
| Compound No. | $Ar^1$ | $Ar^2$ | $Ar^3$ | $R^1$ | $R^2$ | $R^3$ |
|---|---|---|---|---|---|---|
| 1-117 | 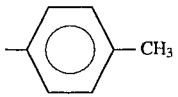 | 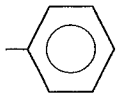 | 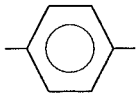 | −H | | 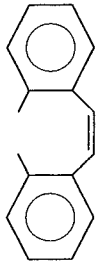 |
| 1-118 | 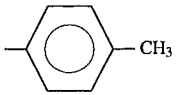 | 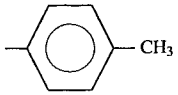 | 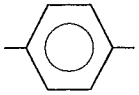 | −H | | 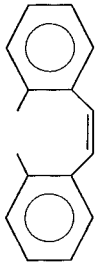 |
| 1-119 | 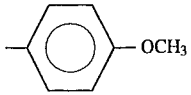 | 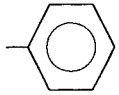 | 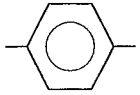 | −H | | 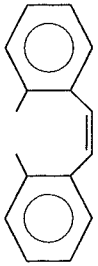 |

TABLE 1-continued
| Compound No. | $Ar^1$ | $Ar^2$ | $Ar^3$ | $R^1$ | $R^2$ | $R^3$ |
|---|---|---|---|---|---|---|
| (b) n = 1 | | | | | | |
| 1-120 | 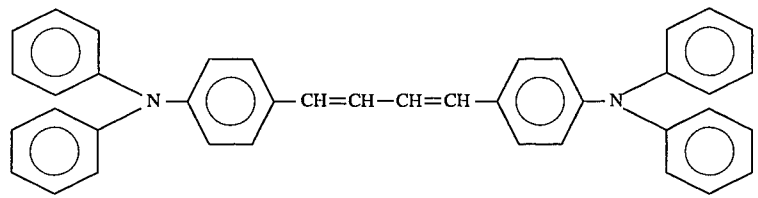 | | | | | |
| 1-121 | 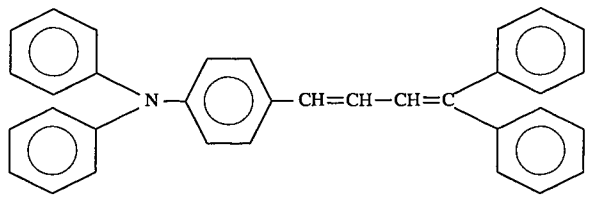 | | | | | |
| 1-122 | 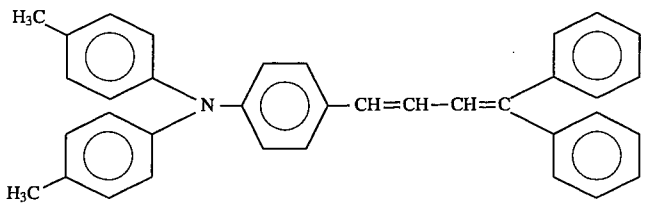 | | | | | |

The above-mentioned charge transporting materials may be used alone or in combination.

Examples of the binder resin for use in the charge transport layer 17 are thermoplastic or thermosetting resins such as polystyrene, styrene - acrylonitrile copolymer, styrene - butadiene copolymer, styrene - maleic anhydride copolymer, polyester, polyvinyl chloride, vinyl chloride - vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

It is preferable that the amount of the binder resin be in the range from 50 to 500 parts by weight to 100 parts by weight of the charge transporting material in the charge transport layer 17.

To form the charge transport layer 17, the charge transporting material, the binder resin, and biphenyl or the biphenyl derivative are dissolved or dispersed in an appropriate solvent such as tetrahydrofuran, dioxane, toluene, monochlorobenzene, dichloroethane or methylene chloride for obtaining a coating liquid for the charge transport layer 17. The thus obtained coating liquid may be coated on the charge generation layer 15 and dried, so that the charge transport layer 17 is provided on the charge generation layer 15.

The thickness of the charge transport layer 17 is preferably in the range from 5 to 50 μm.

The charge transport layer 17 may further comprise a leveling agent. Examples of the leveling agent for use in the present invention include silicone oils such as dimethyl silicone oil and methylphenyl silicone oil; and polymers and oligomers having a perfluoroalkyl group on the side chain thereof. It is preferable that the amount of the leveling agent be in the range from 0 to 1 wt. % of the total weight of the binder resin for use in the charge transport layer 17.

As previously mentioned, the undercoat layer 13 may be provided between the electroconductive support 11 and the charge generation layer 15 in the function-separating photoconductor of the present invention as shown in FIG. 2, or between the electroconductive support and the photoconductive layer in the single-layered electrophotographic photoconductor.

The undercoat layer 13 comprises a resin as the main component. It is desirable that the resin for use in the undercoat layer 13 have high resistance to generally used organic solvents because the photoconductive layer or the charge generation layer 15 and the charge transport layer 17 are provided on the undercoat layer 13 using an organic solvent. Preferable examples of the resin for use in the undercoat layer 13 are water-soluble resins such as polyvinyl alcohol, casein and sodium polyacrylate; alcohol-soluble resins such as copolymerized nylon and n-methoxymethylated polyamide; and cured resins with a three-dimensional network structure such as polyurethane, melamine resin, phenolic resin, alkyd - melamine resin, and epoxy resin.

The undercoat layer 13 may further comprise finely-divided particles of metallic oxides such as titanium oxide, silica, alumina, zirconium oxide, tin oxide and indium oxide to prevent the occurrence of Moiré fringe and reduce the residual potential.

Furthermore, the undercoat layer 13 may comprise a silane coupling agent, a titanium coupling agent or a chromium coupling agent.

The undercoat layer 13 can be formed on the electroconductive support 11 by the same conventional coating method using an appropriate solvent as previously mentioned in the formation of the charge generation layer 15 and the charge transport layer 17. In addition to the above, a thin film of $Al_2O_3$ may be formed as the undercoat layer 13 on the electroconductive support 11 by anodizing process, or a thin film of an organic material such as poly-p-xylylene, or an inorganic material such as $SiO_2$, $SnO_2$, $TiO_2$, ITO or $CeO_2$ may be vacuum-deposited on the electroconductive support 11 to form a thin film of the undercoat layer 13.

The proper thickness of the undercoat layer 13 is in the range from 0 to 5 μm.

As previously mentioned, the protection layer 19 may be formed on the charge transport layer 17 to protect the surface of the photoconductor as shown in FIG. 3.

Examples of a resin for use in the protective layer 19 are acrylonitrile - butadiene - styrene (ABS) resin, styrene - acryl monomer resin, copolymer of olefin and a vinyl monomer, chlorinated polyether, allyl resin, phenolic resin, polyacetal, polyamide, polyamideimide, polyacrylate, polyallysulfone, polybutylene, polybutylene terephthalate, polycarbonate, polyether sulfone, polyethylene, polyethylene terephthalate, polyimide, acrylic resin, polymethylpentene, polypropylene, polyphenyleneoxide, polysulfone, polystyrene, acrylonitrile - styrene (AS) resin, butadiene - styrene copolymer, polyurethane, polyvinyl chloride, polyvinylidene chloride, and epoxy resin.

To improve the wear resistance of the protective layer 19, the protective layer 19 may further comprise a fluorine-containing resin such as polytetrafluoroethylene, and a silicone resin. In such a case, an inorganic material such as titanium oxide, tin oxide or potassium titanate may be dispersed in the above-mentioned fluorine-containing resin or silicone resin.

The protective layer 19 is formed on the charge transport layer 17 by the conventional coating method. In addition to the above, the conventional materials such as a-carbon (amorphous carbon) and a-SiC (amorphous silicon carbide) may be vacuum-deposited on the charge transport layer 17 to form a thin film of the protective layer 19. The thickness of the protective layer is preferably in the range from about 0.1 to 10 μm.

Furthermore, in the electrophotographic photoconductor of the present invention as shown in FIG. 3, an intermediate layer (not shown) may be provided between the charge transport layer 17 and the protective layer 19.

The intermediate layer comprises as the main component a binder resin such as polyamide, alcohol-soluble nylon resin, water-soluble vinyl butyral resin, polyvinyl butyral, or polyvinyl alcohol.

The intermediate layer is formed on the charge transport layer 17 by the conventional coating method. It is preferable that the thickness of the intermediate layer be in the range from about 0.05 to 2 μm.

Other features of this invention will become apparent in the course of the following description of exemplary embodiments, which are given for illustration of the invention and are not intended to be limiting thereof.

EXAMPLE 1

[Formation of Charge Generation Layer]

Five parts by weight of a butyral resin containing a polyvinyl butyral resin component at a molar ratio of 70 mol % were dissolved in 150 parts by weight of cyclohexanone to prepare a butyral resin solution. The butyral resin solution was dispersed in a ball mill for 48 hours with the addition of 10 parts by weight of a trisazo pigment of formula (III) thereto.

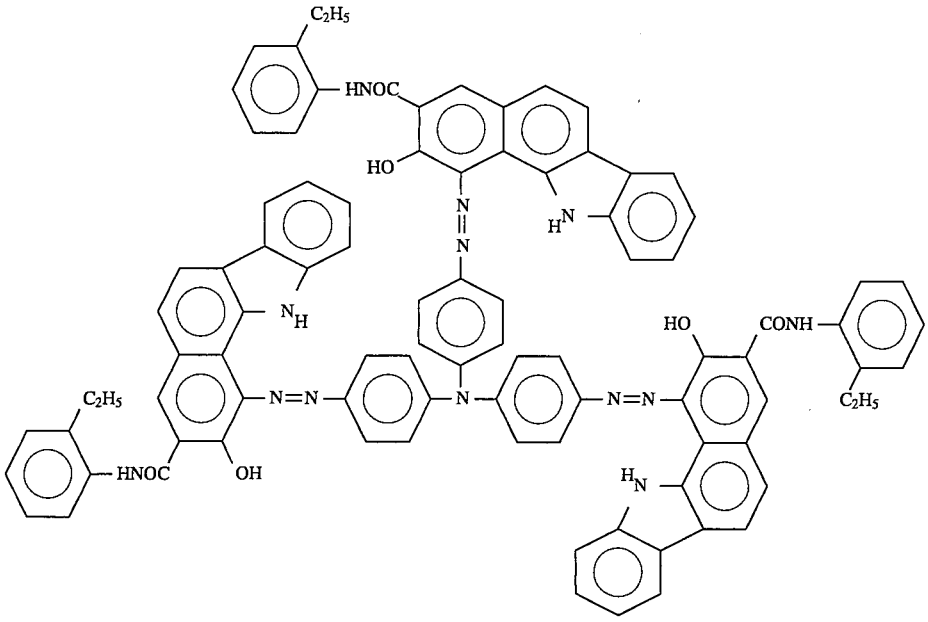

(III)

210 parts by weight of cyclohexanone were further added to the above prepared dispersion, and the obtained mixture was dispersed for 3 hours. The mixture was diluted with cyclohexanone with stirring so that the solid content of the mixture reached 0.9 wt. %. Thus, a coating liquid for a charge generation layer was obtained.

The charge generation layer coating liquid thus obtained was coated on an aluminum-surface of an aluminum-deposited polyethylene terephthalate film with a thickness of 75 μm by a doctor blade, and dried at 80° C. for 2 minutes, so that a charge generation layer with a thickness of 0.2 μm was provided on an electroconductive support.

[Formation of Charge Transport Layer]

Eight parts by weight of a charge transporting material of formula (IV), 10 parts by weight of polycarbonate resin (Trademark "K-1300" made by Teijin Limited.), 2 parts by weight of m-terphenyl and 0.002 parts by weight of silicone oil (Trademark "KF-50" made by Shinetsu Polymer Co., Ltd.) were dissolved in 85 parts by weight of tetrahydrofuran.

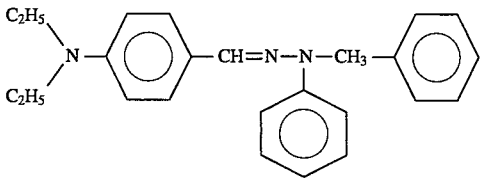

(IV)

Thus, a coating liquid for a charge transport layer was obtained.

The charge transport layer coating liquid thus obtained was coated on the above prepared charge generation layer by a doctor blade, and dried at 130° C. for 10 minutes, so that a charge transport layer with a thickness of 20 μm was provided on the charge generation layer. Thus, an electrophotographic photoconductor No. 1 according to the present invention was obtained.

EXAMPLE 2

The procedure for the preparation of the electrophotographic photoconductor No. 1 in Example 1 was repeated except that the butyral resin for use in the charge generation layer coating liquid employed in Example 1 was replaced with a butyral resin containing a polyvinyl butyral resin component at a molar ratio of 68 mol %, so that an electrophotographic photoconductor No. 2 according to the present invention was obtained.

Comparative Example 1

The procedure for the preparation of the electrophotographic photoconductor No. 1 in Example 1 was repeated except that the butyral resin for use in the charge generation layer coating liquid employed in Example 1 was replaced with a butyral resin containing a polyvinyl butyral resin component at a molar ratio of 65 mol %, so that a comparative electrophotographic photoconductor No. 1 was obtained.

Comparative Example 2

The procedure for the preparation of the electrophotographic photoconductor No. 1 in Example 1 was repeated except that the butyral resin for use in the charge generation layer coating liquid employed in Example 1 was replaced with a butyral resin containing a polyvinyl butyral resin component at a molar ratio of 57 mol %, so that a comparative electrophotographic photoconductor No. 2 was obtained.

Comparative Example 3

The procedure for the preparation of the electrophotographic photoconductor No. 1 in Example 1 was repeated except that m-terphenyl for use in the charge transport layer coating liquid employed in Example 1 was not used in a coating liquid for the charge transport layer, so that a comparative electrophotographic photoconductor No. 3 was obtained.

Each of the above prepared electrophotographic photoconductors Nos. 1 and 2 according to the present invention and comparative electrophotographic photoconductors Nos. 1 to 3 was made into a belt-shaped photoconductor for use in practice in such a manner that an electroconductive layer was provided on both sides of each photoconductor and the photoconductor was cut perpendicularly to the electroconductive layer and both ends were joined so that the electroconductive layer was located on the circumference of the drum-shaped photoconductor.

Each belt-shaped photoconductor was placed in a commercially available facsimile apparatus "RIFAX 2000S" (Trademark), made by Ricoh Company, Ltd. The electric potential characteristics of each photoconductor was evaluated by measuring the electric potential Vd (–V) of the photoconductor at a dark portion which was not exposed to light and the electric potential Vl (–V) of the photoconductor at a light-exposed portion at the initial stage, after making a copy of 5,000 sheets under the circumstances of normal temperature and humidity (23° C., 55% RH), and after making a copy of 1,000 sheets under the circumstances of high temperature and humidity (30° C., 90% RH) by selecting a copy mode.

A 50 mm×50 mm square was cut out of each of the electrophotographic photoconductors obtained in Examples 1 and 2 and Comparative Examples 1 to 3. Each square sample was placed on a flat surface and the height from the flat surface to the end portion of the curled photoconductor was measured to express the curling degree of the photoconductor.

The results are shown in Table 2.

TABLE 2

| | 23° C., 55% RH | | | | 30° C., 90% RH | | | | |
|---|---|---|---|---|---|---|---|---|---|
| | At initial stage | | After making a copy of 5000 sheets | | At initial stage | | After making a copy of 1000 sheets | | Curling |
| | Vd (–V) | Vl (–V) | Vd (–V) | Vl (–V) | Vd (–V) | Vl (–V) | Vd (–V) | Vl (–V) | Degree (mm) |
| Ex. 1 | 730 | 35 | 625 | 45 | 750 | 45 | 705 | 75 | 2.0 |
| Ex. 2 | 735 | 40 | 630 | 50 | 755 | 50 | 710 | 85 | 2.0 |
| Comp. Ex. 1 | 740 | 45 | 640 | 60 | 760 | 60 | 715 | 110 | 2.0 |
| Comp. Ex. 2 | 740 | 45 | 640 | 65 | 765 | 65 | 715 | 130 | 2.0 |
| Comp. Ex. 3 | 700 | 30 | 555 | 35 | 720 | 40 | 630 | 70 | 4.0 |

EXAMPLES 3 to 8 AND COMPARATIVE EXAMPLES 4 to 9

The procedure for the preparation of the electrophotographic photoconductor No. 1 according to the present invention was repeated except that the charge transporting material of formula (IV) for use in the charge transport layer coating liquid employed in Example 1 was replaced by a stilbene compound No. I-10 shown in Table 1, and the molar ratio of a polyvinyl butyral resin component in the butyral resin for use in the charge generation layer coating liquid employed in Example 1 was changed as shown in Table 3, and m-terphenyl serving as a plasticizer for use in the charge transport layer coating liquid in Example 1 was replaced by the respective plasticizers as shown in Table 3.

Thus, electrophotographic photoconductors Nos. 3 to 8 according to the present invention and comparative electrophotographic photoconductors Nos. 4 to 9 were obtained.

The electric potential characteristics and the curling degree of each of the obtained electrophotographic photoconductors were evaluated in the same manner as mentioned in Example 1. The results are shown in Table 3.

TABLE 3

| | Molar Ratio of Polyvinyl Butyral Resin | | 23° C., 55% RH | | | | 30° C., 90% RH | | | | |
|---|---|---|---|---|---|---|---|---|---|---|---|
| | Component in Butyral | | At initial stage | | After making a copy of 5000 sheets | | At initial Stage | | After making a copy of 1000 sheets | | Curling |
| | Resin (mol %) | Plasticizer | Vd (−V) | Vl (−V) | Vd (−V) | Vl (−V) | Vd (−V) | Vl (−V) | Vd (−V) | Vl (−V) | Degree (mm) |
| Ex. 3 | 72 | m-terphenyl | 760 | 15 | 680 | 25 | 775 | 25 | 745 | 40 | 1.0 |
| Ex. 4 | 70 | m-terphenyl | 760 | 20 | 680 | 30 | 780 | 30 | 755 | 50 | 1.0 |
| Ex. 5 | 68 | m-terphenyl | 765 | 25 | 685 | 35 | 785 | 35 | 755 | 60 | 1.0 |
| Ex. 6 | 70 | biphenyl | 760 | 15 | 680 | 25 | 775 | 30 | 745 | 50 | 1.0 |
| Ex. 7 | 70 | o-terphenyl | 760 | 15 | 675 | 25 | 780 | 30 | 750 | 45 | 1.5 |
| Ex. 8 | 70 | p-benzylbiphenyl | 765 | 20 | 685 | 30 | 785 | 35 | 755 | 55 | 1.0 |
| Comp. Ex. 4 | 65 | m-terphenyl | 770 | 30 | 690 | 45 | 790 | 45 | 760 | 95 | 1.0 |
| Comp. Ex. 5 | 57 | m-terphenyl | 775 | 30 | 700 | 45 | 795 | 50 | 765 | 110 | 1.0 |
| Comp. Ex. 6 | 65 | biphenyl | 765 | 25 | 685 | 40 | 780 | 40 | 750 | 90 | 1.0 |
| Comp. Ex. 7 | 65 | o-terphenyl | 765 | 25 | 685 | 40 | 785 | 40 | 755 | 85 | 1.5 |
| Comp. Ex. 8 | 65 | p-benzylbiphenyl | 770 | 30 | 695 | 45 | 790 | 50 | 760 | 100 | 1.0 |
| Comp. Ex. 9 | 68 | — | 715 | 25 | 590 | 30 | 730 | 35 | 660 | 60 | 3.5 |

EXAMPLE 9

[Formation of Charge Generation Layer]

0.5 parts by weight of a butyral resin containing a polyvinyl butyral resin component at a molar ratio of 70 mol% were dissolved in 100 parts by weight of dichloroethane to prepare a butyral resin solution. The butyral resin solution was dispersed by ultrasonic dispersion with the addition of 0.5 parts by weight of X-type metal-free phthalocyanine blue (Trademark "Fastgen Blue 8120B" made by Dainippon Ink & Chemicals, Inc.) thereto. Thus, a coating liquid for a charge generation layer was obtained.

The charge generation layer coating liquid thus obtained was coated on an aluminum-surface of an aluminum-deposited polyethylene terephthalate film with a thickness of 75 μm by a doctor blade, and dried at 80° C. for 2 minutes, so that a charge generation layer with a thickness of 0.2 μm was provided on an electroconductive support.

[Formation of Charge Transport Layer]

Eight parts by weight of a stilbene compound No. I-28 shown in Table 1, serving as a charge transporting material, 10 parts by weight of polycarbonate resin (Trademark "K-1300" made by Teijin Limited.), 2 parts by weight of o-terphenyl and 0.002 parts by weight of silicone oil (Trademark "KF-50" made by Shinetsu Polymer Co., Ltd.) were dissolved in 85 parts by weight of tetrahydrofuran.

Thus, a coating liquid for a charge transport layer was obtained.

The charge transport layer coating liquid thus obtained was coated on the above prepared charge generation layer by a doctor blade, and dried at 130° C. for 10 minutes, so that a charge transport layer with a thickness of 20 μm was provided on the charge generation layer. Thus, an electrophotographic photoconductor No. 9 according to the present invention was obtained.

EXAMPLE 10

The procedure for the preparation of the electrophotographic photoconductor No. 9 in Example 9 was repeated except that the butyral resin for use in the charge generation layer coating liquid employed in Example 9 was replaced with a butyral resin containing a polyvinyl butyral resin component at a molar ratio of 68 mol%, so that an electrophotographic photoconductor No. 10 according to the present invention was obtained.

COMPARATIVE EXAMPLE 10

The procedure for the preparation of the electrophotographic photoconductor No. 9 in Example 9 was repeated except that the butyral resin for use in the charge generation layer coating liquid employed in Example 9 was replaced with a butyral resin containing a polyvinyl butyral resin component at a molar ratio of 65 mol%, so that a comparative electrophotographic photoconductor No. 10 was obtained.

COMPARATIVE EXAMPLE 11

The procedure for the preparation of the electrophotographic photoconductor No. 9 in Example 9 was repeated except that the butyral resin for use in the charge generation layer coating liquid employed in Example 9 was replaced with a butyral resin containing a polyvinyl butyral resin component at a molar ratio of 57 mol%, so that a comparative electrophotographic photoconductor No. 11 was obtained.

COMPARATIVE EXAMPLE 12

The procedure for the preparation of the electrophotographic photoconductor No. 9 in Example 9 was repeated except that o-terphenyl for use in the charge transport layer coating liquid employed in Example 9 was not used in a coating liquid for the charge transport layer, so that a comparative electrophotographic photoconductor No. 12 was obtained.

The electric potential characteristics and the curling degree of each of the electrophotographic photoconductors Nos. 9 and 10 according to the present invention and comparative electrophotographic photoconductors Nos. 10 to 12 were evaluated in the same manner as mentioned in Example 1. The results are shown in Table 4.

TABLE 4

| | 23° C., 55% RH | | | | 30° C., 90% RH | | | | |
|---|---|---|---|---|---|---|---|---|---|
| | At initial stage | | After making a copy of 5000 sheets | | At initial stage | | After making a copy of 1000 sheets | | Curling |
| | Vd (−V) | Vl (−V) | Vd (−V) | VL (−V) | Vd (−V) | Vl (−V) | Vd (−V) | Vl (−V) | Degree (mm) |
| Ex. 9 | 745 | 30 | 660 | 40 | 760 | 40 | 725 | 60 | 1.5 |
| Ex. 10 | 750 | 35 | 665 | 45 | 770 | 45 | 735 | 70 | 1.5 |
| Comp. Ex. 10 | 750 | 40 | 665 | 55 | 770 | 55 | 740 | 100 | 1.5 |
| Comp. Ex. 11 | 755 | 40 | 675 | 60 | 780 | 60 | 750 | 120 | 1.5 |
| Comp. Ex. 12 | 710 | 25 | 585 | 35 | 730 | 35 | 650 | 55 | 3.5 |

As previously explained, the electrophotographic photoconductor with a low residual potential, high durability and excellent environmental stability can be provided according to the present invention. In addition, the curling degree of the photoconductor can be minimized according to the present invention. All of the above-mentioned advantages can be obtained when biphenyl or the biphenyl derivative is added to the photoconductive layer of the single-layered photoconductor or the charge transport layer of the function-separating photoconductor, and the butyral resin containing a polyvinyl butyral resin component at a molar ratio of 68 mol% or more is employed in the photoconductive layer or the charge generation layer.

Furthermore, when the charge transporting material comprises the previously mentioned stilbene derivative as the charge transporting material, those advantages become striking and the photosensitivity of the photoconductor is increased and the charging stability is improved.

What is claimed is:

1. An electrophotographic photoconductor comprising an electroconductive support and a photoconductive layer formed thereon, said photoconductive layer comprising a charge generating material, a binder resin comprising a butyral resin containing a polyvinyl butyral resin component at a molar ratio of 68 mol % or more, a charge transporting material, and biphenyl or a biphenyl derivative.

2. The electrophotographic photoconductor as claimed in claim 1, wherein said charge transporting material for use in said photoconductive layer comprises a stilbene derivative of formula (II):

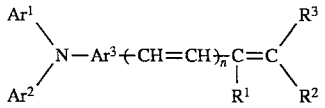

(II)

wherein $Ar^1$ and $Ar^2$ each is an aryl group which may have a substituent or a heterocyclic group which may have a substituent; $R^1$, $R^2$, and $R^3$ each is hydrogen, an alkyl group which may have a substituent, an alkoxyl group which may have a substituent, an aryl group which may have a substituent, or a heterocyclic group which may have a substituent, and $R^2$ and $R^3$ may form a ring in combination; $Ar^3$ is allylene group which may have a substituent; and n is an integer of 0 or 1.

3. The electrophotographic photoconductor as claimed in claim 2, wherein said substituents are an alkyl group, an aryl group or an alkoxy group.

4. The electrophotographic photoconductor as claimed in claim 1, wherein said photoconductive layer comprises a charge generation layer and a charge transport layer, which are successively overlaid on said electroconductive support, said charge generation layer comprising said charge generating material and said binder resin comprising said butyral resin containing a polyvinyl butyral resin component at a molar ratio of 68 mol % or more, and said charge transport layer comprising said charge transporting material, said biphenyl or biphenyl derivative and a binder resin.

5. The electrophotographic photoconductor as claimed in claim 4, wherein said charge transporting material for use in said charge transport layer comprises a stilbene derivative of formula (II):

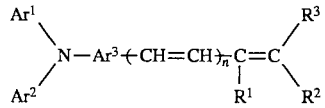

(II)

wherein $Ar^1$ and $Ar^2$ each is an aryl group which may have a substituent or a heterocyclic group which may have a substituent; $R^1$, $R^2$, and $R^3$ each is hydrogen, an alkyl group which may have a substituent, an alkoxyl group which may have a substituent, an aryl group which may have a substituent, or a heterocyclic group which may have a substituent, and $R^2$ and $R^3$ may form a ring in combination; $Ar^3$ is allylene group which may have a substituent; and n is an integer of 0 or 1.

6. The electrophotographic photoconductor as claimed in claim 5, wherein said substituents are an alkyl group, an aryl group or an alkoxy group.

7. The electrophotographic photoconductor as claimed in claim 4, further comprising an undercoat layer which is provided between said electroconductive support and said photoconductive layer.

8. The electrophotographic photoconductor as claimed in claim 4, further comprising a protective layer which is provided on said photoconductive layer.

9. The electrophotographic photoconductor as claimed in claim 8, further comprising an intermediate layer which is provided between said photoconductive layer and said protective layer.

* * * * *

UNITED STATES PATENT AND TRADEMARK OFFICE

CERTIFICATE OF CORRECTION

PATENT NO. : 5,561,016

DATED : October 1, 1996

INVENTOR(S) : Yasuo SUZUKI, et al.

It is certified that error appears in the above-identified patent and that said Letters Patent is hereby corrected as shown below:

Column 4, line 45, "thin oxide" should read --tin oxide--.

Column 5, line 15, "may be coating" should read --may be coated--.

Column 46, line 13, "the protection layer" should read --the protective layer--.

Signed and Sealed this

Thirtieth Day of September, 1997

*Attest:*

*Attesting Officer*

Bruce Lehman

BRUCE LEHMAN

*Commissioner of Patents and Trademarks*